US005397076A

United States Patent [19]

Padilla

[11] Patent Number: 5,397,076

[45] Date of Patent: Mar. 14, 1995

[54] PRE-PREPARED PASTER PATTERNS

[75] Inventor: Edward R. Padilla, Lambertville, N.J.

[73] Assignee: Man Roland Druckmaschinen AG, Offenbach am Main, Germany

[21] Appl. No.: 78,482

[22] Filed: Jun. 16, 1993

Related U.S. Application Data

[63] Continuation of Ser. No. 805,872, Dec. 9, 1991, abandoned.

[51] Int. Cl.[6] ..... B65H 19/18

[52] U.S. Cl. ..... 242/556.1

[58] Field of Search ..... 242/58–58.6, 242/556.1; 156/157, 502, 504, 505

[56] References Cited

U.S. PATENT DOCUMENTS

| | | | |
|---|---|---|---|
| 2,212,937 | 8/1940 | Horton | 242/58.5 |
| 2,214,719 | 9/1940 | Freeman | 242/58.5 |
| 2,361,857 | 10/1944 | McMullen | 242/58.5 |
| 2,377,971 | 6/1945 | Roesen | 242/58 |
| 2,553,928 | 5/1951 | McMullen | 242/58.5 |
| 2,646,938 | 7/1953 | Wieking | 242/58.5 |
| 2,812,145 | 11/1957 | Meloche | 242/58.5 |
| 2,998,205 | 8/1961 | Francik | 242/58.3 |
| 3,001,735 | 9/1961 | Francik | 242/58.5 |
| 3,231,949 | 2/1966 | Phipps | 24/67 |
| 3,724,033 | 4/1973 | Baker | 242/67 AR |
| 3,787,264 | 1/1974 | Underwood | 156/157 |
| 4,290,834 | 9/1981 | Buettel | 156/157 |
| 4,575,017 | 3/1986 | Pali | 242/58.3 |
| 4,683,022 | 7/1987 | Watanabe et al. | 156/505 |
| 4,685,392 | 8/1987 | Watanabe | 242/58.5 |
| 4,812,198 | 3/1989 | Fuke et al. | 156/505 |
| 4,905,924 | 3/1990 | Moore | 242/58.5 |
| 5,212,002 | 5/1993 | Madrzak et al. | 242/58.5 X |
| 5,275,344 | 1/1994 | Ray | 242/58.5 |
| 5,301,891 | 4/1994 | Duguay | 242/58.5 |

*Primary Examiner*—Daniel P. Stodola
*Assistant Examiner*—John P. Darling
*Attorney, Agent, or Firm*—Frishauf, Holtz, Goodman & Woodward

[57] ABSTRACT

A pre-prepared paster pattern designed to effectively create a splice between the first web of a first roll of paper feeding into a high speed printing press and the leading edge of the second web of a second replacement roll of paper. The paster pattern comprises a first extensive paper layer having two generally triangularly shaped portions adapted on a first side to be adhesively connected to the end portion of the replacement roll and to a web portion of the replacement roll spaced from the end portion. An array of pressure sensitive adhesive layers are applied to the second and opposing side of the first paper layer and are adapted to adhere to the first web of the first roll while the first web is being fed into the high speed printing press. A very tacky adhesive layer is applied to the second side at the apex of each triangular portion and is protected by a removable cover or release paper layer. A second extensive cover or release paper layer overlies the first paper layer and is releasably adhered thereto. The second layer is designed to protect the pressure sensitive adhesive on the first layer during non-splicing operations whereby on removal of the second layer, the pressure sensitive adhesive is undamaged and has maximum adhesive properties so as to effect reliable splices between the webs of the rolls.

14 Claims, 3 Drawing Sheets

PRE-PREPARED PASTER PATTERNS

This application is a continuation of application Ser. No. 07/805,872, filed Dec. 9, 1991, now abandoned.

FIELD OF THE INVENTION

The present invention relates to paster patterns which are used with roll fed printing presses.

BACKGROUND

Web-fed printing presses print on continuous webs of paper supplied in rolls. Roll fed printing presses are used wherever speed is important. This requirement applies to newspapers, magazines, and many other type of commercially printed products. In the production of the above items, speed is of the utmost importance. Many ancillary services depend on this speed.

One concern in such printing plants is the continuous feed of paper into the printing press. Printing presses which are operating at extremely high speeds and that they use up paper at a very high rate. When a roll of paper such as newsprint is about to expire, it is therefore of compelling importance that a new roll be fed into the press without slowing the press and without any interruption or break in the stream of paper. If, for example, a new roll is improperly introduced to the press so that the press must be shut down to correct the error, all of the concomitant problems that go with this delay come into play. Consequently, a continuous feed of paper to supply these large high speed presses is of paramount importance.

In the past, it has been conventional to introduce a new roll of newsprint into a press on the expiration or almost expiration of the preceding roll. This has been done by making splices between the rolls so that the new roll feeds into the press on the expiration of the old roll. When these rolls are rotating at tremendously high speeds, effecting of a splice between the rolls is extremely difficult.

In order to effect the splice between an expiring and a new roll at high rotational speeds, it has been customary to use a paster or a paster pattern. There have been numerous paster patterns used for this purpose, see for example, Rosen U.S. Pat. No. 2,377,971; Melache U.S. Pat. No. 2,812,145; Francik U.S. Pat. No. 3,001,735; Phipps U.S. Pat. No. 3,231,949; Baker U.S. Pat. No. 3,724,033 and Underwood U.S. Pat. No. 3,787,264.

It has also been conventional for journeymen printers in the news printing business to construct their own patterns by applying glue to the surface of a new roll in various forms to effect the splice.

All of these prior art devices and customs have been only partially effective and none have solved the problem of providing a satisfactory splice on a reliable basis. Unofficial statistics have indicated that over the past two decades or so, the efficiency of roll splicing has been somewhere in the vicinity of 98%. That means that 2% of the time, the splice is not effective, the press must be shut down and all of the delays heretofore described arise. The loss of time and money involved in these situations is such that getting as close as one can to a 100% sure splicing method is of great importance.

SUMMARY OF THE INVENTION

It is an object of the invention to provide a pre-prepared paster pattern which is capable of effecting perfect and reliable splicing. In a recent test conducted at a large metropolitan newspaper printing plant, the paster pattern or tab of this invention has been effectively 99.4% successful. Splices have been made without interruption to the great satisfaction of the operators. This success has been achieved because the paster patterns of this invention can be manufactured in advance to specific tolerances as to size, adhesive, adhesive location and coverage and adhesive protection. The paster pattern can be applied to the roll in advance, and prior to its introduction into the press and, on removal of the protective covering on the pattern, provides a reliable, fresh adhesive surface. In operation, the paster is effectively operable. This reliability is of great importance to the industry and has solved a long felt problem.

More particularly, the paster pattern of this invention is constructed in what may be called a triangular shape or double triangular shape such that the base of the triangle is applied to the leading edge of the new roll of paper and the apex of the triangle, which is spaced a substantial distance from the base, includes adhesive portions on both sides so that the paster may be secured to the roll to hold the leading edge in place and when adhesively engaged on the other side, will effect a splice to an old or expiring roll which is presently feeding paper into the printing press. In between the apex and the base of the paster is provided a substantial glue pattern which insures proper permanent connection between the paster and the expiring old roll. The surface of the apex is provided with a highly pressure sensitive adhesive which will immediately grab and adhere to the expiring roll and bring into play the remainder of the extensive adhesive pattern on the paster. Further, the pattern is provided with blank areas so that the rotating drive belts do not interfere with or contact any of the adhesive surfaces which would destroy the paster and eliminate the splicing possibilities. Over all of this adhesive surface is provided a protective layer which remains in position until just before the paster is to become operable for a splice. This insures that the adhesive surfaces are fresh and have not lost any of their adhesive capabilities and have not picked up any foreign objects such as lint, dust or the like.

It had been customary in the past for operators to apply their own adhesive in various shapes just before splicing to avoid decay in the adhesive qualifies of the adhesive. Doing this has many disadvantages and could result in inoperative splices. The paster pattern of this invention having a predetermined shape, size, adhesive pattern and covering obviates all of these problems and provides for the possibility of a successful splice every time.

DETAILED DESCRIPTION OF THE PREFERRED EMBODIMENT

Figure 2:
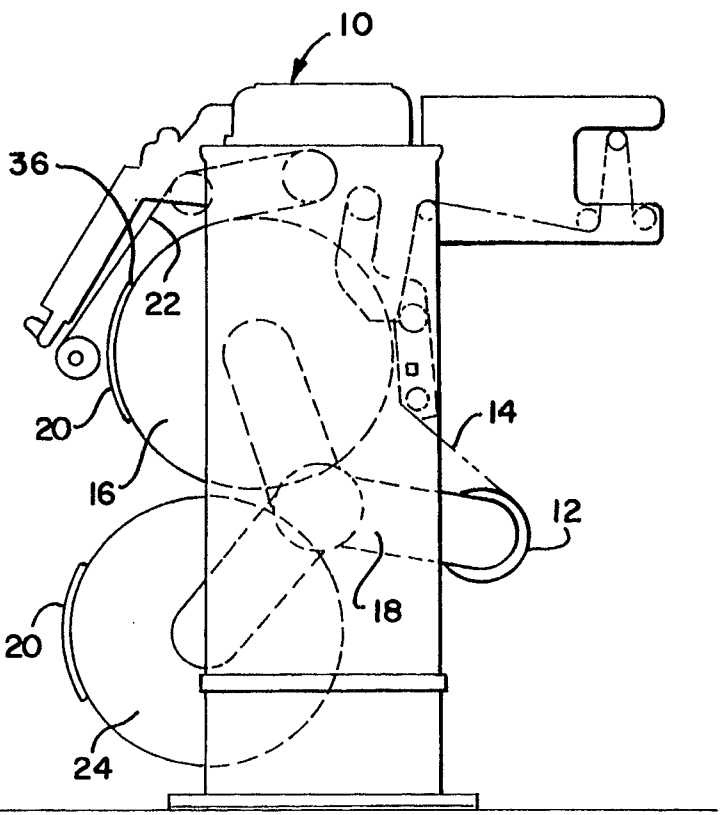
FIG. 2 is a diagrammatic side view of the unit shown in FIG. 1 showing the standby roll, new roll and expiring old roll.
Figure 1:
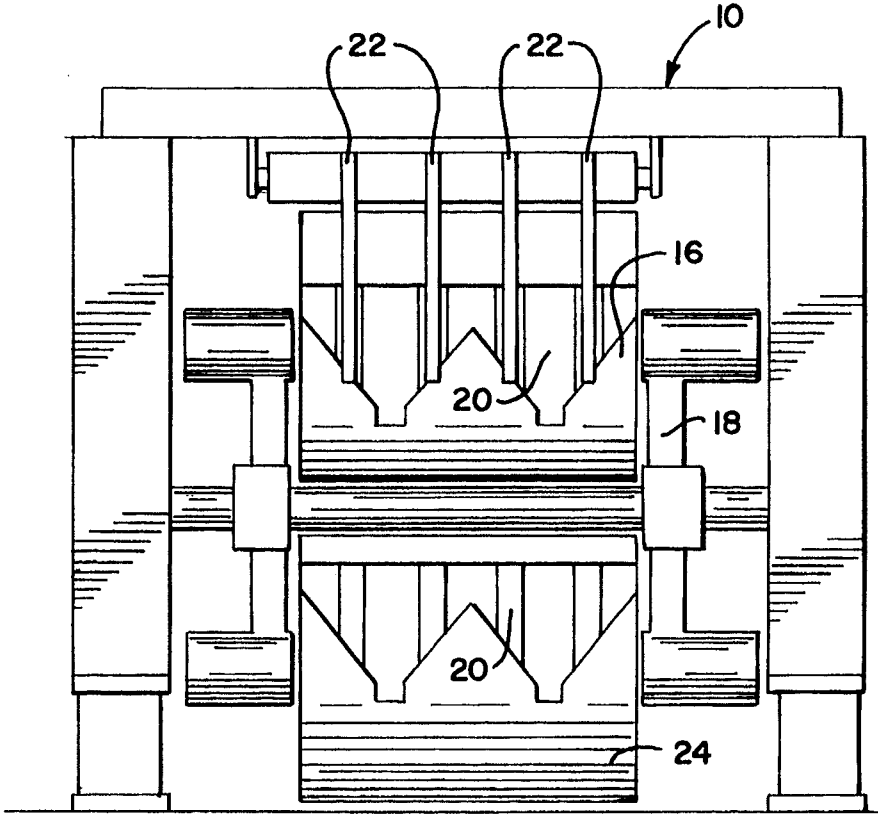
FIG. 1 is diagrammatic end view of a newspaper reel showing a new roll and a standby roll of paper, both with the paster pattern of this invention in place.
Figure 7:
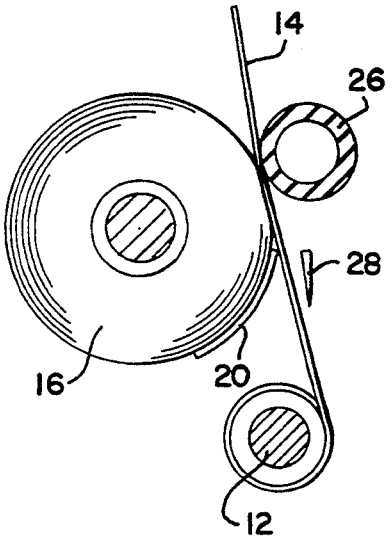
Figure 8:
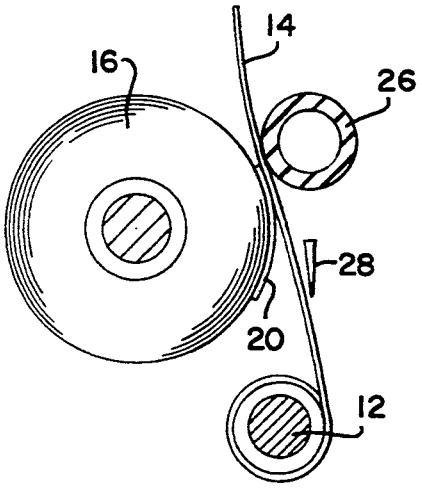
Figure 9:
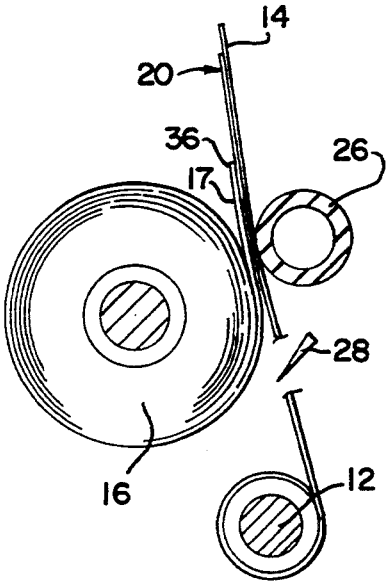

Referring now specifically to the drawings, and in particular to FIGS. 1 and 2 and 6 through 9, which best put the paster pattern of this invention in the proper perspective; FIGS. 1 and 2, as previously mentioned, are diagrammatic views of a reel carrier 10 for a printing press (not shown) showing the paper roll 12 in use (sometimes called the expiring roll) and the web 14 therefrom being fed into the press. Also shown, is the new roll or next roll 16 having a web 17 (FIG. 9). The rolls 12 and 16 are rotatably positioned on the spider 18. Web 17 is arranged to be spliced to the web 14. Splicing is provided by the paster pattern 20 of this invention which will be explained in greater detail hereafter.

Also shown in FIGS. 1 and 2 are the drive belts 22 which rotate the new roll 16. The new roll 16 must be rotating at a speed such that the web 17 can be dispensed from the new roll 16 at the same linear speed as that of the web 14 of the expiring roll 12 which is being dispensed in order to make an effective splice.

Spider 18 also supports a standby roll 24. Once the new roll 16 is spliced into the web 14, it will run from that position until roll 16 is almost exhausted. At that time, the spider 18 is rotated so that the roll 16 takes the position of the expiring roll 12 and the standby roll 24 then assumes the position of the new roll 16. This process continues over and over again.

Figure 6:
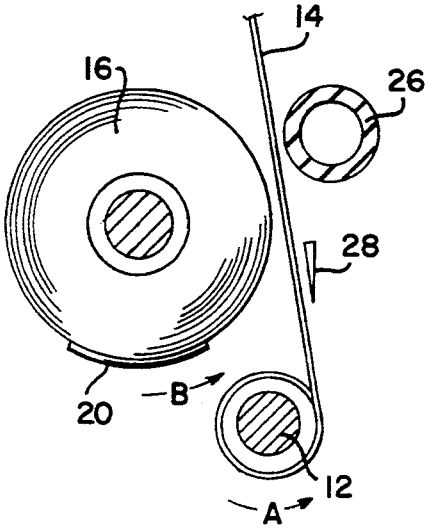
FIGS. 6, 7, 8 and 9 are diagrammatic views which show in sequence the effecting of a splice between an expiring roll and a new roll using the paster pattern of this invention.

All of this is done in order to provide a continuous feed of paper stock 14 or 17 to the press and in order to effect this continuous feed, the paster pattern of this invention must effect a satisfactory splice between the webs 14 and 17. FIGS. 6 through 9, which are diagrammatic views, show the effecting of such a splice. FIG. 6 shows the condition of the expiring roll 12 and the new roll 16 with the pattern 20 in place adhesively attached to the end of the web 17 of the new roll 16 just before the operation to effect the splice begins. Also shown in FIG. 6 is what is called a foam marriage roll 26 and a cutting knife 28. In this view, the web 14 is being fed into the printing press (not shown). The foam marriage roll 26, a roller which is covered by a flexible foam material (or a brush), is designed to press web 14 against roll 16 with sufficient pressure for the adhesive on the pattern 20 to take hold. In this view, expiring roll 12 is rotating in a counter-clockwise direction as shown by the arrow "A" and the new roll 16 is also rotating in a counter-clockwise direction as shown by the arrow "B". The new roll 16 is rotating at a speed such that the end of the web 17 on the outside surface of the new roll 16 is moving at the same linear feet per minute rate of speed as the linear feet per minute rate of speed that the web 14 is being fed into the press.

In FIG. 7, the marriage roll 26 has moved against the web 14 and the new roll 16 and the paster pattern 20 has rotated to a position where it is almost in adhesive contact with the web 14.

In FIG. 8, the marriage roll 26, the web 14, the pattern 20 and the new roll 16 have all come into contact and an adhesive joining between the web 14 and the pattern 20 attached to the new roll 16 has taken place.

In FIG. 9, the new roll 16 and its attached pattern 20 are joined to the web 14 and the cutting knife 28 has been activated to sever the web 14 and thereby disconnect the web 14 of the expiring roll 12 from the remainder of the old roll 12. All of this operation takes place with split second timing and at a very high speeds, both rotational and linear.

Figure 3:
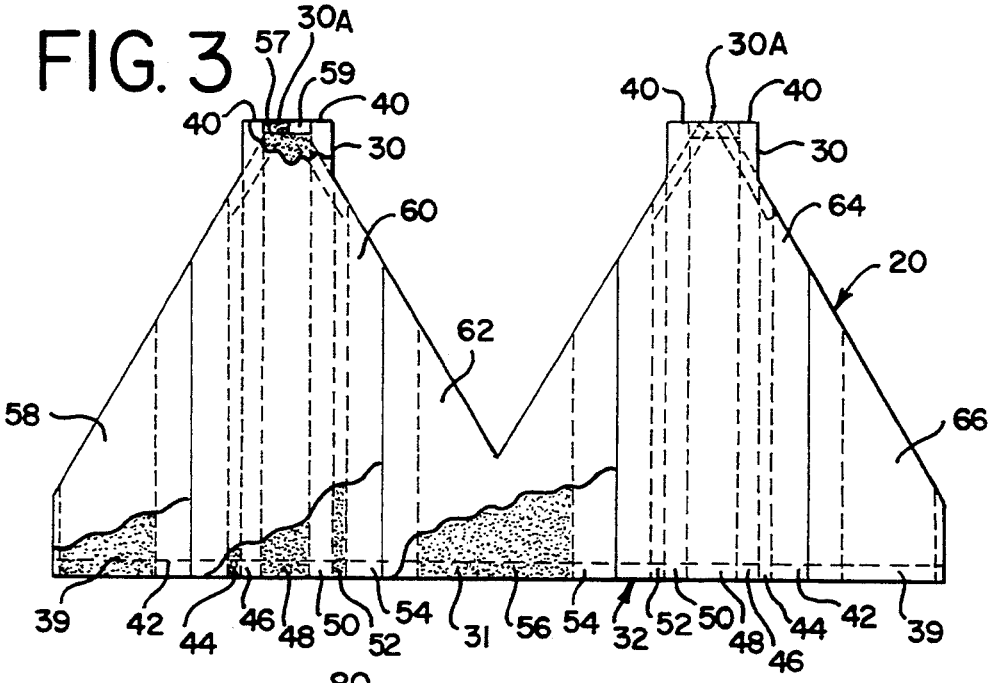
FIG. 3 is a top plan view of a double triangle paster pattern of this invention partially broken away to show the various glue patterns.
Figure 4:
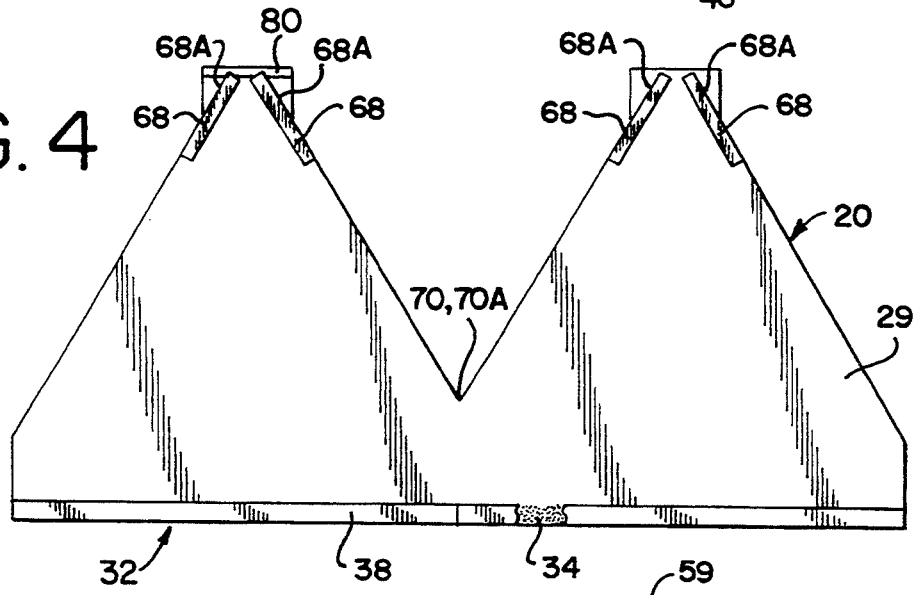
FIG. 4 is a bottom plan view of the pastern pattern of this invention partially broken away to show the various glue patterns.

Referring now to the paster pattern 20 itself which is the invention of this application; FIGS. 3 and 4 show the elements of its construction. Pattern 20 is made of paper that is sufficiently strong to resist tearing under normal circumstances but is not so strong that it will not easily tear where desired in the splicing operation. The pattern shown in FIG. 3 is of a double triangle construction with the apexes of the triangle 30 being truncated as at 30A. The base 32 of the pattern 20 is the sum of the bases of the two triangles and its width is substantially that of the width of the roll that it will join to. On the rear side 29 of the base 32 is a strip of pressure sensitive adhesive 34. This strip of adhesive 34 is designed to adhere the pattern 20 to the leading edge or free edge 36 (FIG. 9) of the web 17 on the new roll 16. When the pattern 20 is to be applied to a new roll 16, a release cover 38 on the strip of adhesive 34 is removed exposing the pressure sensitive adhesive and the pattern is then adhered to the leading edge 36 of the new roll of paper 16. In order that the leading edge 36 and the paster pattern 20 are held firmly in position the pattern is attached by a separate tape 80 (FIG. 4) the back of which is seen in FIG. 3 at 40 adjacent to truncated ends 30A of the triangles 30. These tapes allow the apexes of triangles 30 to be adhesively attached to the surface of the web 17 on the new roll 16. This holds the leading edge 36 and the pattern 20 firmly in position on the roll.

The front surface 31 of the paster pattern 20 is provided with several pressure sensitive adhesive coated areas which are carefully positioned to avoid contact with any surface other than a desired surface and in particular, designed to avoid contact with the drive belts 22 which rotate the new roll 16 to a satisfactory speed. The non-coated areas also allow air to escape during the splicing operation. Thus, looking at FIG. 3 starting from the left hand edge of the paster, there is an adhesive area 39, a non-adhesive area 42, a narrow strip of adhesive 44 and a non-adhesively coated area 46. Next is a wider strip of adhesive 48 and a non-adhesive area 50. Next comes another narrow strip of adhesive 52 and a strip 54 that is not coated with adhesive. In the center portion of the paster pattern 20 is a wide strip of adhesive 56. The pattern of adhesive and non-adhesive strips repeat on the right hand portion of the paster with the same reference numbers. The adhesive used in the these areas is product TP 120 general purpose latex emulsion manufactured by Technicote Inc. of Miamisburg, Oh.

The non-adhesive areas 42, 46, 50 and 54 are of a width and length to accommodate the drive belts 22, without those belts contacting any adhesive area. In prior art pasters, the location of the adhesive in relation to the drive belt areas on the pattern has always been a serious concern because any overlap or misplacement of the adhesive would cause bind-up with the drive belts and effectively destroy the use of the paster. By the careful application of the pressure sensitive adhesive to the paster pattern of this invention, that problem is avoided.

In order to provide instant adhesion to the web 14 in the splice operation, an area 57 of very tacky material is provided at each truncated apex 30A of the pattern 20. This adhesive is tackier than the adhesive used on the remainder of the pattern, so that an instant connection will take place the moment the foam marriage roll 26 presses the web 14 against the new roll 16 with pastern pattern 20 thereon. The adhesive used in area 57 is manufactured by the 3M Company and is their Scotch Brand product 913 Repulpable Newsprint Splicing Tape.

The tackiness of the adhesive of conventional paster patterns begins to weaken as soon as the adhesive is exposed. This may be due to the evaporation of the solvents in the adhesive when they are exposed to air. In order to protect the adhesive on the paster pattern 20 of this invention, all of the adhesive areas are sealed with protective covers or release sheets which are not to be removed until just prior to the use of the paster 20 for a splice. Thus, the adhesive area 57 is covered with a protective cover 59 and the remainder of the paster pattern 20 is also covered by five separate covers 58, 60, 62, 64 and 66. All of these protective covers have a treated inner surface, such as with a silicone compound, so that they readily release from the adhesive surface but protect the adhesive surface while they are in place. The separate covers 58, 60 may overlap the edges.

As previously explained, the leading edge of paster pattern 20 is held to the surface of the new roll 16 by tapes 80 applied at the apex 309. In the splicing operation, it is important that the leading edge of the paster pattern tear loose from this connection as soon as the adhesive area 57 joins the web 14. In order to direct the tearing operation, strengthening or reinforcing tape 68 is located on the rear side 29 of the paster 20. The presence of this tape causes the tearing to occur along the lines 68A and thus complete the tearing process quickly and with little shock to the expiring web of paper 14.

It can be appreciated that this pastern pattern 20 can be duplicated in exact dimensions and adhesive locations and that the size of the paster 20 as manufactured is always the same. Further, the protection provided for the adhesive areas ensures that the adhesive itself does not loose its adhesive qualities. Thus, the paster pattern 20 can be manufactured in large quantities, has substantial shelf life and can be applied to a roll of paper and left in position with the adhesive covered until just before the splice is to be performed, thus assuring effectively 100% consistency in splicing.

Figure 5:
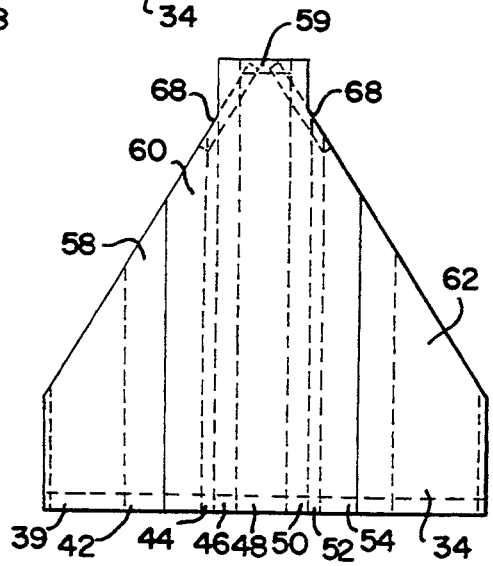
FIG. 5 is a top plan view of a single triangle of the paster pattern of this invention.

FIG. 5 shows an alternate construction of the paster of this invention which only has one triangle. The construction of this pattern is the same as the pattern shown in FIG. 3 and the numbers applied thereto are the same applied to FIGS. 3 and 4. This paster pattern is used in the same way as the pattern shown in FIG. 3.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed:

1. A pre-prepared paster pattern (20) designed to effectively create a splice between a first or expiring web (14) of a first roll (12) of paper feeding into a high-speed printing press and an end portion (17) of a second, or new, or replacement web of a second, or new, or replacement roll (16) of paper, comprising a paster element having at least one base portion (32), each having a length substantially equal to the width of the second, or new, or replacement web, said paster element having at least one triangular portion, the base portion or portions (32) of the paster element defining the base or bases of the triangle or triangles formed by the triangular portion or portions, and the apex or apeces of the triangular portion or portions being adapted to be removably adhered to a web region of the new, or replacement roll;

a first pressure-sensitive adhesive region (34) located at a first side (29) of said paster element and extending across the length of said paster element, and hence substantially across the width of the second, or new, or replacement web, said first pressure-sensitive adhesive region being adapted to be adhesively connected to the end portion (17) of the second, or new, or replacement roll (16);

a first release paper layer (38) substantially congruent with, and overlying said first pressure-sensitive adhesive region (34) of said paster element, and releasably adhered thereto;

an array of pressure-sensitive adhesive regions (39, 44, 48, 52, 56) applied to a second side (31), opposite said first side of said first paster element, and adapted to adhere to the first or expiring web (14) of the first roll (12) while the first or expiring web is moving and is being fed into the high-speed printing press, wherein said array of pressure-sensitive adhesive regions form individual strips of adhesive (39, 44, 48, 52) extending in a longitudinal direction with respect to the first, or expiring web, separated by non-adhesive strip-like engagement areas (42, 46, 50, 54), said non-adhesive strip-like areas providing engagement areas for rotating means (22) for providing rotation to the replacement roll (16), and which allow for escape of air during the splicing operation, when said first web (14) of the first roll (12) and the end portion (17) of the second web of the replacement roll (16) are pressed together; and a second release paper layer means (58, 60, 62, 64, 66) overlying said strips of adhesive of the array of pressure-sensitive adhesive regions, said first release paper layer (38) and said second release paper layer means being designed to protect the first pressure-sensitive adhesive region (34) and said pressure-sensitive strips of adhesive (39, 44, 48, 52) during non-splicing operations, whereby, on removal of said respective release paper layer, a pressure-sensitive adhesive on said region and on said strips is undamaged and has maximum adhesive properties so as to effect reliable splicing between the webs of the rolls.

2. A pre-prepared paster pattern as in claim 1, wherein said paster element has two triangularly shaped portions with the bases of the triangularly shaped portions being contiguous and together being substantially equal to the width of the replacement roll and being adapted to be adhesively connected to the end portion of the replacement roll.

3. A pre-prepared paster pattern as in claim 2, wherein the apex of both the triangular portions is truncated.

4. A pre-prepared paster pattern as in claim 2, wherein the apex of each of the triangular portion or portions is truncated;

including an area of pressure-sensitive adhesive (57) located adjacent the ends of said truncated triangular portion or portions on the second side (31); and a further layer (59) of release paper covering said pressure-sensitive adhesive (57).

5. A pre-prepared paster pattern as in claim 1, wherein the apex of the triangular portion or portions is truncated.

6. A pre-prepared paster pattern as in claim 5, including a pressure-sensitive adhesive tape (80) located at the truncated apex of said triangular portions, so that said apex is adapted to be removably adhered to a surface of said second, or new, or replacement web underlying the end portion (17) of the new, or replacement roll (16) by said pressure-sensitive adhesive tape, and to allow the apex to be controllably torn free from said underlying layer of the second web during the moment of splicing.

7. A pre-prepared paster pattern as in claim 6, including reinforcement means (68) for strengthening the triangle, located adjacent the apex of the triangular portion or portions, and extending along the sides of the apex of said triangular portion or portions and adjacent thereto.

8. A pre-prepared paster pattern as in claim 1, wherein said second releasable paper layer means (58, 60, 62, 64, 66) comprises a plurality of discrete and separate sheets.

9. A pre-prepared paster pattern as in claim 8, wherein said plurality of discrete and separate sheets overlap one over the other at the edges.

10. A combination of a new, or replacement, or second roll of paper (16) adapted for splicing to a web (14) of an expiring or first roll (12) of paper being fed at high speed into a high-speed printing press, said new, or replacement, or second roll (16) of paper including a web having a web end portion (17), said combination further including a pre-prepared paster pattern (20) comprising a paster element having at least one base portion (32), each having a length substantially equal to the width of the second, or new, or replacement web, said paster element having at least one triangular portion, the base portion or portions (32) of the paster element defining the base or bases of the triangle or triangles formed by the triangular portion or portions, and the apex or apeces of the triangular portion or portions being adapted to be removably adhered to a web region of the new, or replacement roll;

a first pressure-sensitive adhesive region (34) located at a first side (29) of said paster element and extending across the length of said paster element, and hence across the width of the second, or new, or replacement web, said first pressure-sensitive adhesive region being adapted to be adhesively connected to the end portion (17) of the second, or new, or replacement roll (16);

a strip-like array of pressure-sensitive adhesive regions (39, 44, 48, 52, 56) applied to a second and opposing side (31) of said first paper layer and adapted to adhere to the web (14) of the first roll (12) of paper while the first roll of paper is being fed into the high-speed printing press, non-adhesive strip-like areas (42, 46, 50, 54) between the adhesive strip-like regions of the pressure-sensitive array;

said non-adhesive strip-like areas providing engagement areas for rotating means (22) for providing rotation to the replacement roll (16), and which allow for escape of air during the splicing operation, when said first web (14) of the first roll (12) and the end portion (17) of the second web of the replacement roll (16) are pressed together;

a first release paper layer (38) substantially congruent with and overlying said first pressure-sensitive adhesive region (34) of said paster element and releasably adhered thereto; and a second release paper layer (58, 60, 62) covering and protecting said array of pressure-sensitive adhesive regions on said second side during non-splicing operations, whereby, upon removal of said release paper layers, a pressure-sensitive adhesive means on said adhesive regions (39, 44, 48, 52, 56) will be undamaged and have maximum adhesive properties so as to effect reliable splices between said webs of said first and second rolls, said release paper layers protecting said adhesive means and regions.

11. The combination of claim 10, wherein, the apex of the triangular portion or portions is truncated and adapted to be removably adhered to the web of the new, or replacement, or second roll (16) of paper.

12. The combination of claim 12, wherein said second release paper layer comprises a plurality of discrete and separate sheets (58, 60, 62, 64, 66), said discrete and separate sheets overlapping at least over the edges of said adhesive strips.

13. The combination of claim 12, wherein said plurality of discrete and separate sheets overlap one over the other at the edges.

14. The combination of claim 10, in further combination with the rotating means (22) for rotating the new, or replacement, or second roll (16), wherein the rotating means (22) comprises belt means positioned for engagement with the surface of the new, or replacement, or second roll; and wherein the non-adhesive strip-like areas (42, 46, 50, 54) are positioned on the paper element at locations of engagement of the belt means with the surface of the new, or replacement, or second roll (16), and the pressure-sensitive adhesive regions (39, 44, 48, 52, 56) of said array of pressure-sensitive adhesive regions are located laterally, with clearance, of said belt means.

* * * * *